US008943981B2

(12) United States Patent
Kelly et al.

(10) Patent No.: US 8,943,981 B2
(45) Date of Patent: Feb. 3, 2015

(54) REINFORCED PLASTIC PALLET

(71) Applicant: Daniel Kelly, Medford, NJ (US)

(72) Inventors: Daniel Kelly, Medford, NJ (US); Jeffery Jacobs, Lexington, SC (US); James Favaron, Columbia, SC (US); John A. Spadavecchia, Red House, VA (US)

(73) Assignee: Daniel Kelly, Medford, NJ (US)

( * ) Notice: Subject to any disclaimer, the term of this patent is extended or adjusted under 35 U.S.C. 154(b) by 0 days.

(21) Appl. No.: 13/804,181

(22) Filed: Mar. 14, 2013

(65) Prior Publication Data

US 2014/0261103 A1 Sep. 18, 2014

(51) Int. Cl.
*B65D 19/38* (2006.01)
*B65D 19/00* (2006.01)

(52) U.S. Cl.
CPC .. *B65D 19/0006* (2013.01); *B65D 2519/00034* (2013.01); *B65D 2519/00069* (2013.01); *B65D 2519/00398* (2013.01)
USPC ..... 108/57.25

(58) Field of Classification Search
CPC ..... B65D 2519/00034; B65D 2519/00069; B65D 2519/00104; B65D 2519/00129; B65D 2519/00139; B65D 2519/00398; B65D 2519/00462; B65D 2519/00432; B65D 2519/00472
USPC ..... 108/57.25, 51.11, 51.3, 57.26, 57.28, 108/901, 902
See application file for complete search history.

(56) References Cited

U.S. PATENT DOCUMENTS

| | | | | | |
|---|---|---|---|---|---|
| 5,413,052 | A * | 5/1995 | Breezer et al. | 108/56.1 |
| 5,836,255 | A * | 11/1998 | Uitz | 108/57.25 |
| 5,868,080 | A * | 2/1999 | Wyler et al. | 108/57.25 |
| 6,109,190 | A * | 8/2000 | Hale et al. | 108/57.25 |
| 6,125,770 | A * | 10/2000 | Brandenburg | 108/57.25 |
| 6,622,642 | B2 * | 9/2003 | Ohanesian | 108/57.25 |
| 6,748,876 | B2 * | 6/2004 | Preisler et al. | 108/57.25 |
| 7,004,083 | B2 * | 2/2006 | Ramirez von Holle et al. | 108/57.25 |
| 7,165,499 | B2 * | 1/2007 | Apps et al. | 108/57.25 |
| 7,640,867 | B2 * | 1/2010 | Ogburn et al. | 108/56.3 |
| 7,841,281 | B2 * | 11/2010 | Valentinsson | 108/57.25 |
| 7,845,289 | B2 * | 12/2010 | Apps | 108/57.25 |
| 8,215,244 | B2 * | 7/2012 | Apps | 108/57.25 |
| 8,499,701 | B2 * | 8/2013 | Ritzberger | 108/57.25 |
| 2008/0236455 | A1 * | 10/2008 | Naidu | 108/56.1 |
| 2011/0120353 | A1 * | 5/2011 | Jensen et al. | 108/57.25 |

* cited by examiner

*Primary Examiner* — Jose V Chen
(74) *Attorney, Agent, or Firm* — Glenn M. Massina, Esq.; Fox Rothschild LLP

(57) ABSTRACT

A pallet including top and bottom decks supported in spaced apart relationship by a plurality of post assemblies. A reinforcement assembly is encapsulated within at least one of the top or bottom deck. The reinforcement assembly includes at least one reinforcement rod having opposed ends and a plurality of reinforcement caps. Each reinforcement cap has an outer member defining a closed end and an open end and an inner compensation structure within the outer member and defining a stop surface spaced from the outer member open end such that an initial open area is defined within the outer cap member. A respective rod end is received in the initial open area. The inner compensation structure is configured to deform to accommodate a relative position change between the cap member and the reinforcement rod end.

26 Claims, 7 Drawing Sheets

REINFORCED PLASTIC PALLET

FIELD OF THE INVENTION

The present invention relates to the field of pallets useful in material handling, and more particularly, to a reinforced plastic pallet.

BACKGROUND OF THE INVENTION

Pallets have been in wide use for many years to minimize the cost of handling products or articles that can be stacked or otherwise secured on them to thus enable large volumes of products or articles to be handled simultaneously and to be handled in mechanized fashion so as to minimize labor costs. Historically, fork-lift pallets have been constructed of wood, having a plurality of parallel stringers on which are nailed or otherwise secured one or more structural members defining a pallet platform. The pallet platform can be composed of multiple wood strips or unitary wood panels, such as plywood panels, to provide a generally planar support surface on which the goods or articles are appropriately arranged or stacked. The parallel stringers raise the product support platform above a floor surface and thereby permit the forks of a fork-lift truck to be inserted within spaces defined between the stringers. This enables a fork-lift truck to lift and move the pallet with all of its articles as a unit or package. Typically, the pallet will remain with the products or articles until such time as the articles are removed from the pallet for further handling, for use or for distribution.

Even though pallets are typically of low cost, they are sufficiently costly that they are used many times for shipment of products before they become sufficiently worn or damaged that replacement is necessary. Although wood has historically been a low cost commodity, thus enabling pallets to be manufactured of wood at low cost, of late, the cost of wood for products such as pallets has significantly increased, thus causing pallet manufacturers to seek other sources for materials. Pallets have been constructed of extruded or formed metal such as steel or aluminum.

With the growth of the plastics industry a wide variety of plastics have been investigated to determine their suitability for use in producing pallets. Plastic pallets can easily be molded and are stronger and lighter weight than wooden pallets. They can also be made with recyclable materials. Furthermore, plastic pallets are more durable than wooden pallets, however, may be subject to weakness as the amount of material is reduced to lower weight and cost.

To increase the durability of plastic pallets, various reinforcing elements or rods have been used. While the reinforcing elements have improved the strength of the pallets, many applications, referred to as clean applications, prohibit exposed reinforcing elements. Encasing the reinforcing elements within the pallet plastic has proven challenging as the difference in thermal coefficient between the plastic and the metal of the reinforcing elements has resulted in cracking or other adverse effects. Attempts to avoid the thermal effects have resulted in complex systems, for example, preformed, full length sleeves to separately encase the reinforcing elements. Such sleeves have added to the cost and complexity of manufacturing the pallets.

SUMMARY OF THE INVENTION

Briefly, the present invention provides a plastic pallet with a reinforcement assembly embedded within at least one of the decks and including reinforcement caps to accommodate the effects of thermal contraction or expansion.

In one aspect, the invention provides a pallet including top and bottom decks supported in spaced apart relationship by a plurality of post assemblies. A reinforcement assembly is encapsulated within at least one of the top or bottom deck. The reinforcement assembly includes at least one reinforcement rod having opposed ends and a plurality of reinforcement caps. Each reinforcement cap has an outer member defining a closed end and an open end and an inner compensation structure within the outer member and defining a stop surface spaced from the outer member open end such that an initial open area is defined within the outer cap member. A respective rod end is received in the initial open area. The inner compensation structure is configured to deform to accommodate a relative position change between the cap member and the reinforcement rod end.

In another aspect, the invention provides a method of forming a pallet including positioning a reinforcement cap on each end of at least one reinforcement rod; positioning the at least one reinforcement rod in a mold in a desired configuration; and molding top and bottom decks and the post assemblies of the pallet such that the at least one reinforcement rod and the reinforcement caps thereon are embedded within the top and/or bottom deck.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
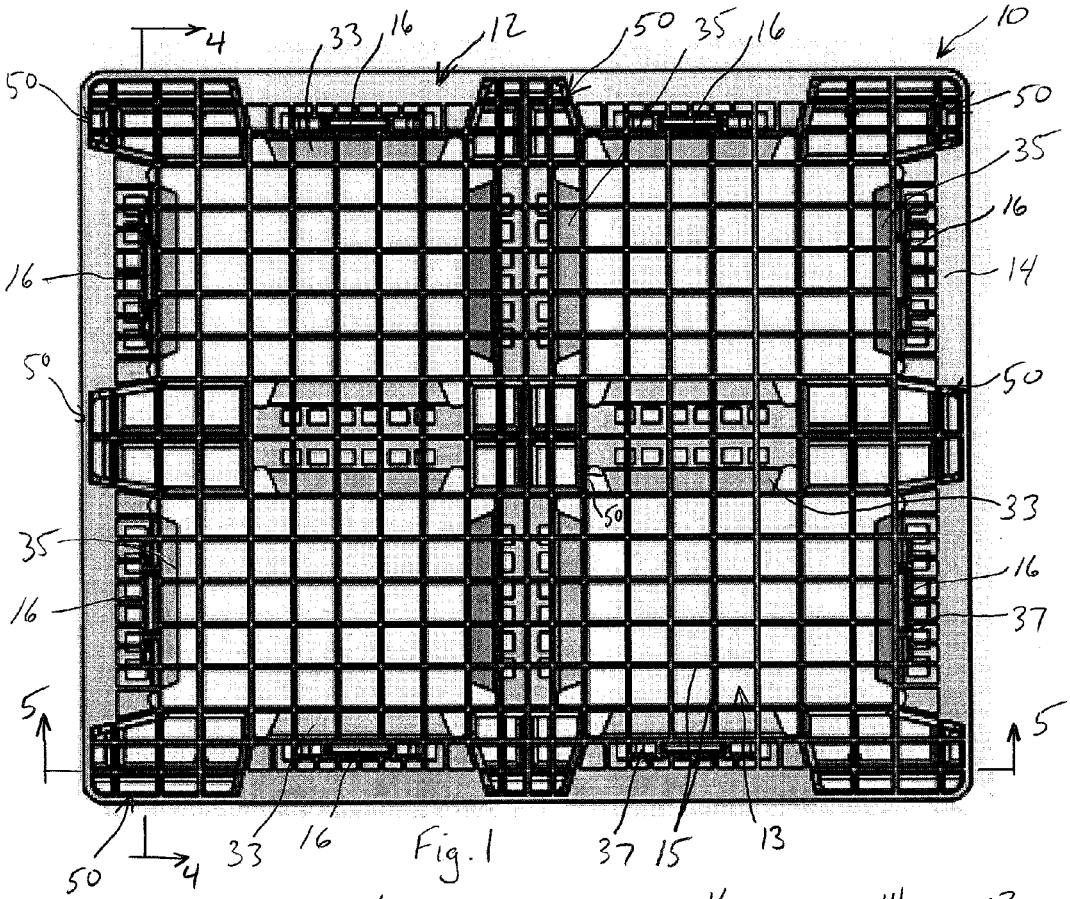
FIG. 1 is a top plan view of a pallet in accordance with an embodiment of the present invention.
Figure 2:
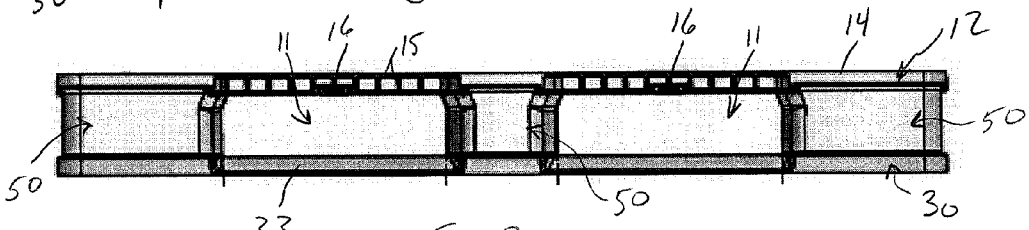
FIG. 2 is a front elevation view of the pallet of FIG. 1.
Figure 3:
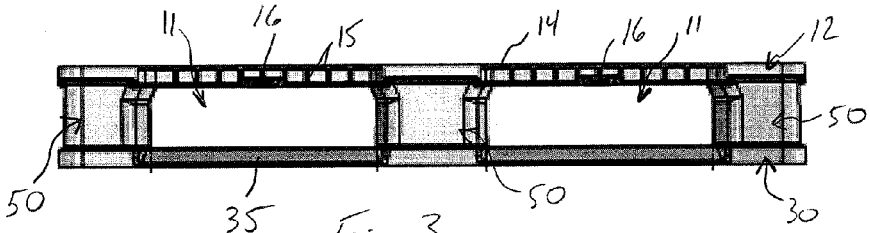
FIG. 3 is a side elevation view of the pallet of FIG. 1.

In the drawings, like numerals indicate like elements throughout. Certain terminology is used herein for convenience only and is not to be taken as a limitation on the present invention. For example, the terms front, back, left and right are utilized herein to assist with understanding of relative positioning, but are not intended to be limiting to an orientation of use of the device. The following describes a preferred embodiment of the present invention. However, it should be understood, based on this disclosure, that the invention is not limited by the preferred embodiment described herein.

Referring to FIGS. 1-5, a pallet 10 in accordance with an exemplary embodiment of the present invention will be described. The pallet 10 generally comprises a top deck 12 interconnected to a bottom deck 30 via a plurality of post assemblies 50. The post assemblies 50 maintain the top deck 12 and bottom deck 30 in spaced relationship such that fork receiving openings 11 are defined along each lateral edge of the pallet 10 between the post assemblies 50. The present embodiment includes nine post assemblies 50, but may include more or fewer post assemblies 50.

The top deck 12 of the present embodiment includes a generally planar surface 14 supported by an interconnected rib structure 15. The top deck 12 may be a solid surface, but the rib structure 15 is generally preferred as it reduces weight and material cost. The surface 14 preferably includes a plurality of through holes 13 to facilitate passage of water, debris and the like through the pallet top deck 12. Optionally, one or more elastomeric grommets 16 may extend through the top deck 12. In the illustrated embodiments, the grommets 16 are aligned with the fork receiving openings 11 such that the lower portions of the grommets 16 reduce slipping between the pallet 10 and the fork tines (not shown). The grommets 16 may also extend above the top surface 14 to reduce slipping of items positioned on the pallet 10. The top deck 12 is not limited to the illustrated embodiments and may have various other configurations for accommodating and supporting various cargo and rack structures.

The bottom deck 30 preferably includes a first series of beam members 33 interconnected with a second series of beam members 35 extending orthogonal thereto to form a grid structure. While the illustrated structure is preferred, the bottom deck 30 may include more or fewer beams, or alternatively, be a planar structure similar to the top deck 12. The plank members 33, 35 again preferably include a supporting rib structure 37, but are not limited to such a configuration. In the preferred embodiment, the planks 33 and 35 are formed interconnected as a unitary grid structure 34.

Each post assembly 50 is defined by an outer post member 52 extending between the top deck 12 and the bottom deck 30. In the preferred embodiment, the outer post members 52 are formed integrally with both the top deck 12 and the bottom deck 30 such that the pallet 10 is generally a one-piece assembly. It is recognized that aspects of the invention may be utilized with multi-component pallets with separate top and bottom decks and with singular or multi-component posts. As with the top and bottom decks 12, 30, ribs 54 preferably extend within the outer post members 52.

The decks 12 and 30 and post assemblies 50 can be manufactured from any suitable material, including, plastics and various other natural or synthetic materials. Various molding techniques, for example, but not limited to, injection molding or gas assist injection molding, may be utilized.

Figure 4:
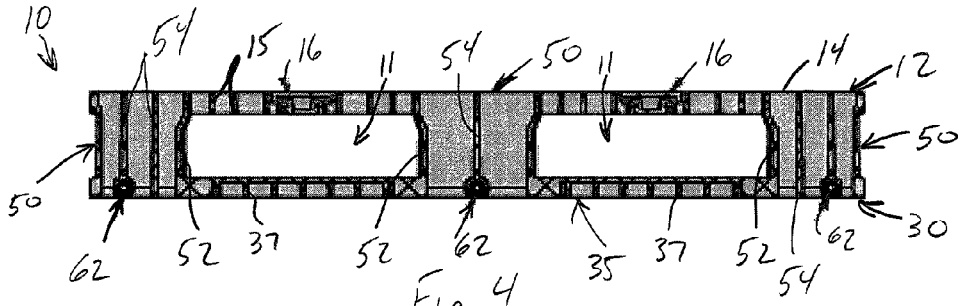
FIG. 4 is a cross-sectional view along the line 4-4 in FIG. 1.
Figure 5:
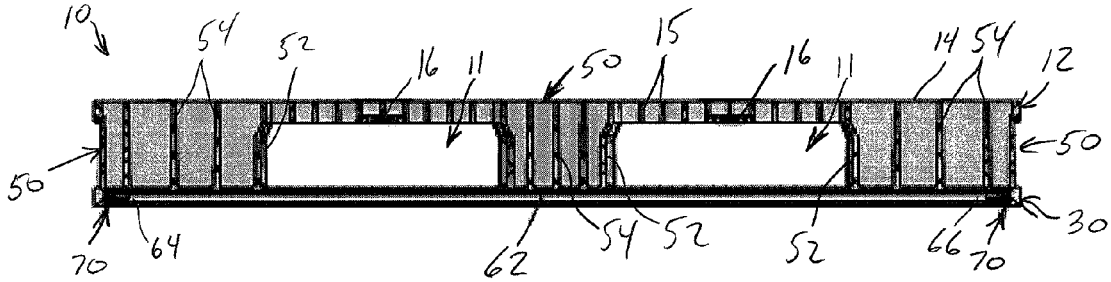
FIG. 5 is a cross-sectional view along the line 5-5 in FIG. 1.
Figure 6:
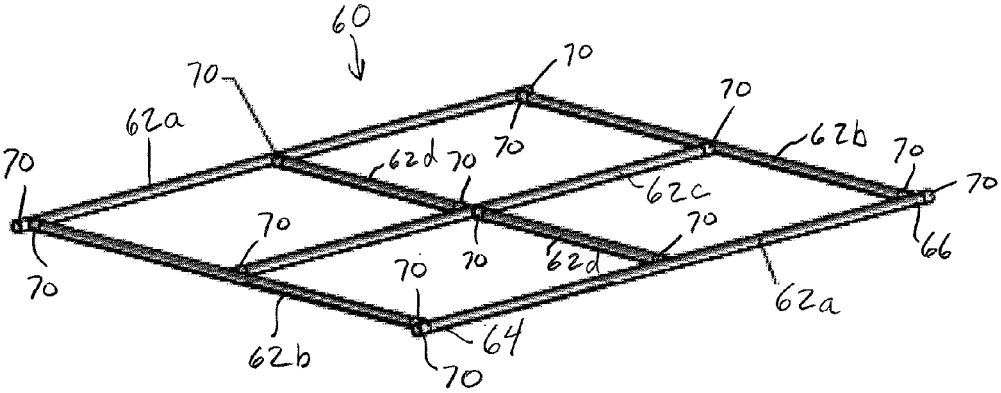
FIG. 6 is a perspective view of an exemplary reinforcement assembly prior to molding.
Figure 7:
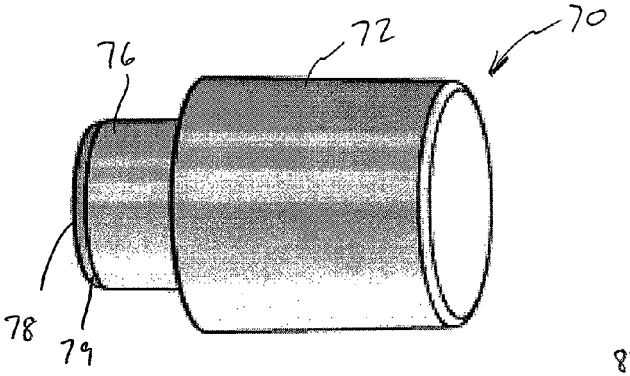
FIG. 7 is a perspective view of an exemplary reinforcement cap.

Referring to FIGS. 4-6, a reinforcement assembly 60 is molded within the lower deck 30 to provide additional strength to the pallet 10. While the reinforcement assembly 60 is described only in conjunction with the lower deck 30, it may be provided additionally or alternatively in the upper deck 12. The reinforcement assembly 60 includes a plurality of reinforcement rods 62 forming a grid which matches the grid of the beam members 33, 35. While the illustrated assembly 60 includes a reinforcement rod 62 in each beam member 33, 35, other variations are possible, for example, some beam members may have zero rods 62 or more than one rod 62.

In the embodiment illustrated in FIG. 6, the outer longitudinal rods 62*a* are the longest and extend along the longitudinal length of the pallet 10. The outer lateral rods 62*b* extend between the rods 62*a* and extend along the lateral width of the pallet 10. The inner longitudinal rod 62*c* is shorter than the outer rods 62*a* such that it fits between the lateral rods 62*b*, generally parallel to and equidistant between the outer longitudinal rods 62*a*. Each of the inner later rods 62*d* is slightly less than half the width of the pallet 10 such that each inner later rod 62*d* extends between the inner longitudinal rod 62*c* and a respective outer longitudinal rod 62*a*. Each inner lateral rod 62*d* extends generally parallel to and equidistant between the outer lateral rods 62*b*. This is an exemplary grid configuration for illustrative purposes. Other configurations may be utilized.

Each reinforcement rod 62 is preferably a hollow cylinder extending between ends 64, 66. While the preferred rods are hollow, other rods including solid or partially filled rods may be utilized. Additionally, while the illustrated rods are cylindrical, they may have other shapes, for example, but not limited to, square, rectangular or I-beam. The reinforcement rods 62 are preferably metallic, for example, steel, but may be made from other metals and non-metals, for example, reinforced fiberglass.

A reinforcement cap 70 is positioned at each end 64, 66 of each reinforcement rod 62. The reinforcement caps 70 help to accommodate differentials in post mold shrinkage and also thermal expansion and contraction of the pallet beams 33, 35 relative to the reinforcement rods 62.

Referring to FIGS. 7-10, an exemplary reinforcement cap 70 will be described. Each exemplary reinforcement cap 70 includes an outer annular cap member 72 having a closed end 73 and an open end 74 with a length L1 therebetween. An inner cap member 76 is positioned within the outer annular cap member 72, preferably coaxial therewith. The inner cap member 76 extends from a first end 77, formed co-planar with the outer cap member closed end 73, to an opposite end 78 and has a length L2 greater than the outer member length L1 such that the inner member 76 extends from the open end 74. The extending end 78 of the inner cap member 76 preferably has a tapered edge 79 to facilitate receipt of the inner member 76 into a respective rod end 64, 66. The inner member 76 is illustrated as a hollow structure, but is not limited to such. The outer and inner members 72, 76 of the exemplary embodiment are cylindrical to correspond to the configuration of the rods 62. The cap members 72, 76 may have other configurations which allow attachment to the rod ends 64, 66, however, the cap 70 configuration does not have to be identical to that of the rods 62.

Figure 8:
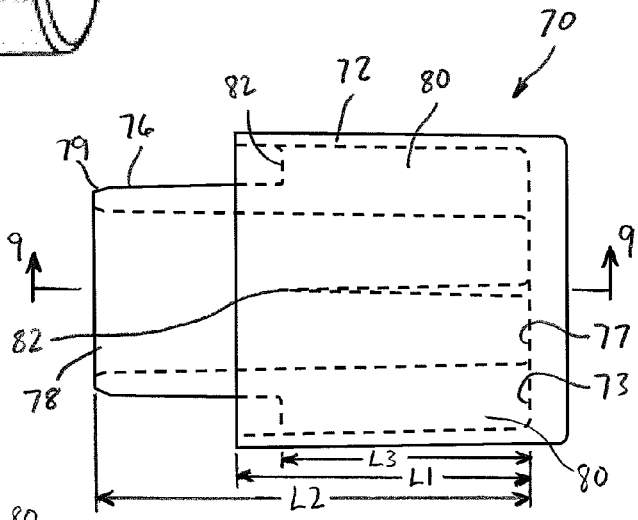
FIG. 8 is a side view of the exemplary reinforcement cap of FIG. 7.
Figure 9:
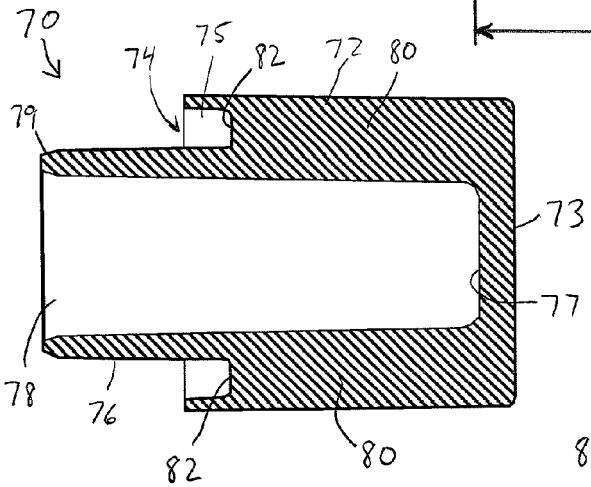
FIG. 9 is a cross-sectional view along the line 9-9 in FIG. 8.
Figure 10:
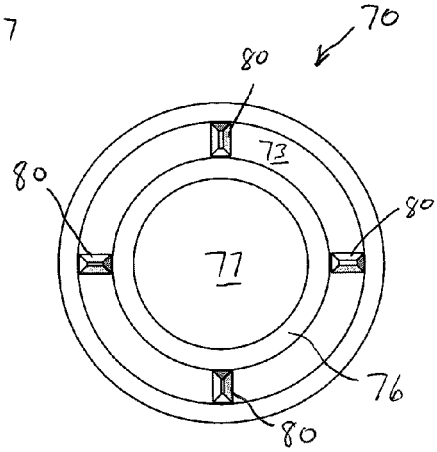
FIG. 10 is an end elevation view of the exemplary reinforcement cap of FIG. 7.
Figure 11:
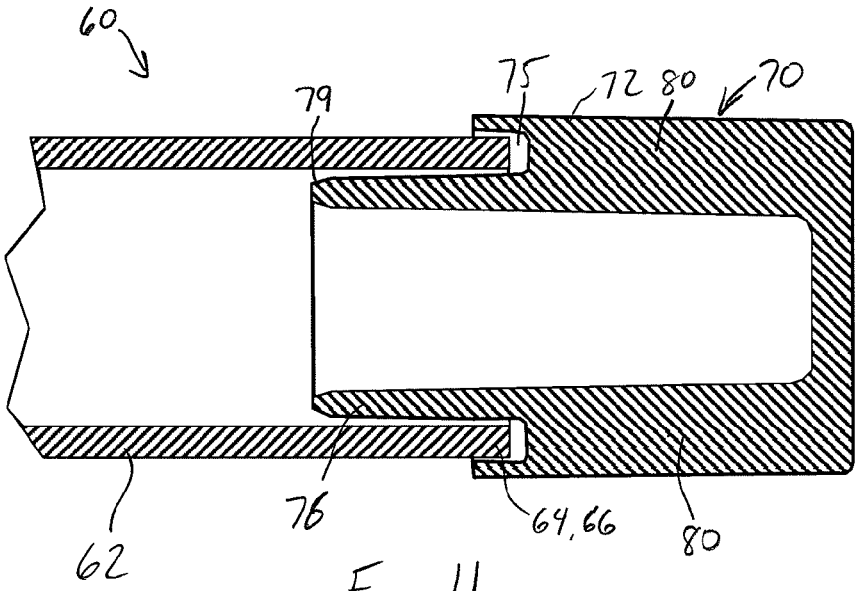
FIG. 11 is a cross-sectional, partial view of an exemplary reinforcement rod assembled with an exemplary reinforcement cap.

To accommodate contraction or expansion of the pallet 10, an inner compensation structure is defined within each cap 70. In the present embodiment, the inner compensation structure is defined by a plurality of ribs 80 extending between the outer cap member 72 and the inner cap member 76 from the closed ends 73, 77 to a rib free end 82. Four ribs 80 are shown in the exemplary embodiment, however, more or fewer ribs 80 may be utilized. The length L3 of each rib 80 is less than the length L1 of the outer cap member 72 such that a hollow annular area 75 is defined within the outer cap member 72 between it and the inner cap member 76. The hollow annular area 75 is configured to receive the end 64, 66 of a reinforcement rod 62 as illustrated in FIG. 11. The free ends 82 of the ribs 80 define a stop which limits initial positioning of the rod end 64, 66 within the outer cap member 72, but the caps 70 do not extend over a substantial length of the rods 62. In an exemplary embodiment, the annual area 75 has an initial depth of about 0.125 inches and the inner cap member 76 extends into the rod end 64, 66 by about 0.5 inches. As illustrated in FIG. 8, the ribs 80 of the present embodiment taper, narrowing toward the free ends 82, however, the ribs 80 may not include such a taper (see for example FIG. 17). As will be described hereinafter, the ribs 80 are configured to crush or otherwise deform to accommodate differentials in post mold shrinkage and also thermal expansion and contraction of the pallet beams 33, 35 relative to the reinforcement rods 62.

The reinforcement caps 70 may be manufactured from a plastic or other suitable material, including metals. Exemplary materials include, but are not limited to nylon 6/6 or die cast zinc. Additionally, different portions of the caps 70 may be manufactured from different materials. In exemplary pallet, the beam members 33, 35 are be manufactured from polypropylene, the reinforcement caps 70 are manufactured from nylon 6/6 and the reinforcement rods 62 are manufactured from steel.

Figure 12:
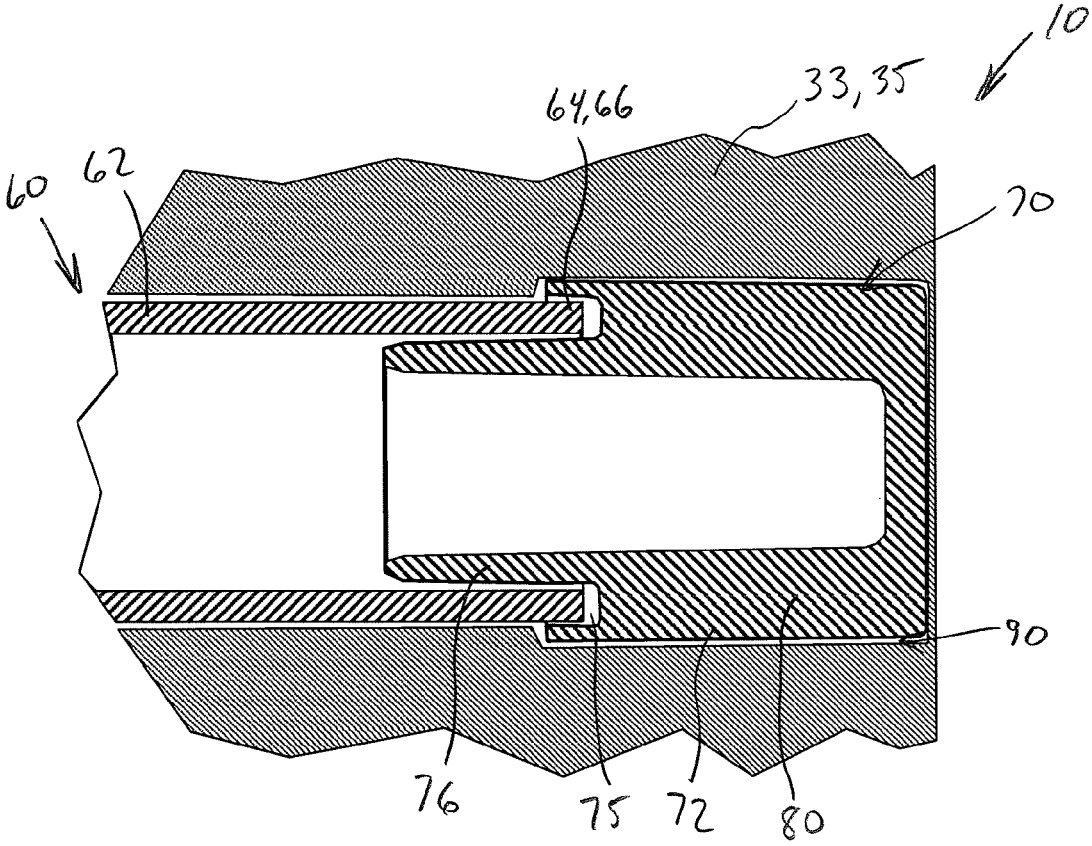
FIG. 12 is a cross-sectional, partial view of the exemplary reinforcement assembly initially molded within a pallet beam.

Prior to molding, a reinforcement cap 70 is positioned on each end 64, 66 of each reinforcement rod 62 as illustrated in FIG. 11. The reinforcement rods 62 with the reinforcement caps 70 at each end 64, 66 are then positioned in a mold (not shown) in the desired grid pattern as illustrated in FIG. 6. Upon molding, the material of the lower deck beam members 33, 35 is formed about and encapsulates the rods 62 and caps 70 of the reinforcement assembly 60 as shown in FIG. 12.

Figure 13:
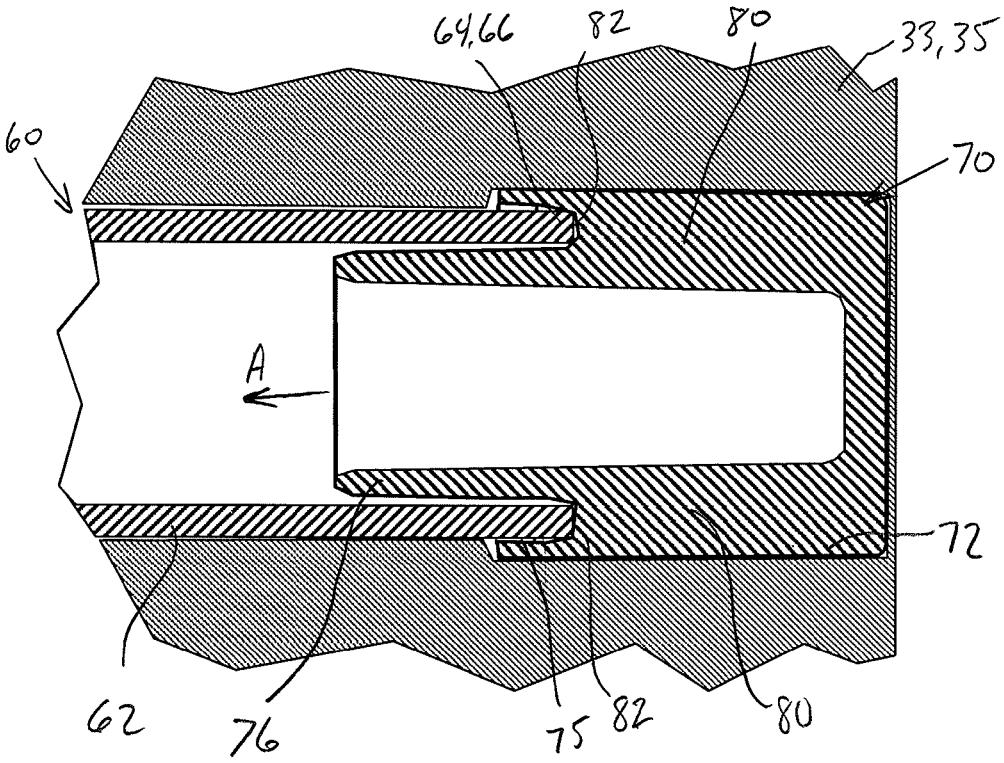
FIG. 13 is a cross-sectional, partial view similar to FIG. 12 illustrating the assembly after post mold shrinkage.

The molded beam members 33, 35 have an initial position relative to the reinforcement assembly 60 when the pallet 10 is removed from the mold. This is illustrated in FIG. 12 with a slight gap 90 between the beam members 33, 35 and the reinforcement rods 62 and the reinforcement caps 70. The gap 90 is for illustrative purposes and may not be to scale. Upon removal from the mold, as the pallet 10 cools, the pallet 10 typically experiences shrinkage. However, the reinforcement rods 62 are generally not subject to the same shrinkage and therefore the beam members 33, 35 and the reinforcement caps 70 will shrink relative to the reinforcement rods 62 as indicated by arrow A in FIG. 13. The ribs 80 of the reinforcement caps 70 accommodate this change in relative position. As the end 64, 66 of the reinforcement rod 62 presses against the free ends 82 of the ribs 80, the ribs 80 are configured to crush or otherwise deform and the end 64, 66 of the rod 62 simply passes further into the space between the outer and inner cap members 72 and 76. Upon complete post-molding shrinkage, the rod ends 64, 66 will be securely positioned within the reinforcement cap 70 as illustrated in FIG. 13.

Figure 14:
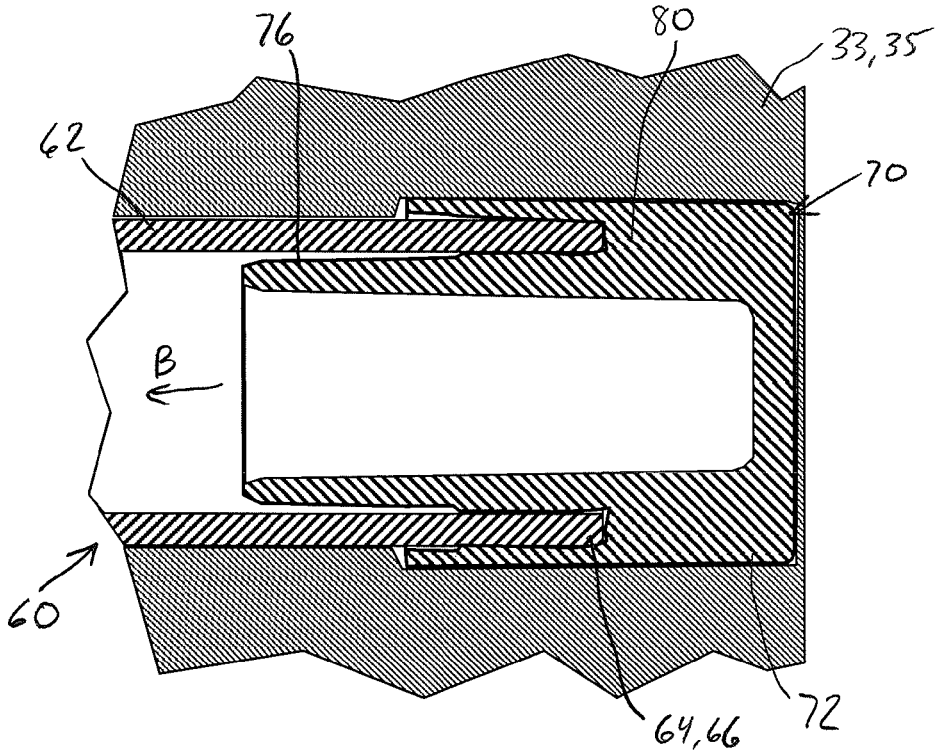
FIGS. 14 and 15 are cross-sectional, partial views similar to FIG. 12 illustrating exemplary thermal expansion and contraction between the reinforcement rod and the pallet beam.
Figure 15:
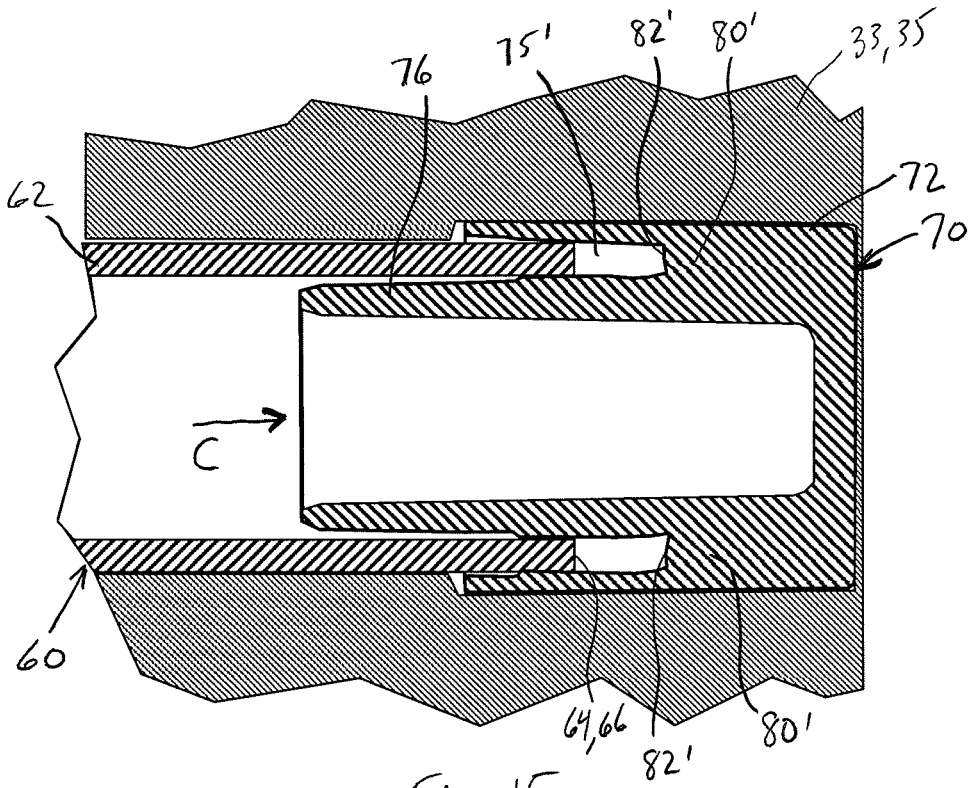

In use, the pallet 10 may undergo further contraction when utilized in cold conditions or expansion when utilized in hot conditions. The reinforcement caps 70 will accommodate such contraction or expansion in a manner similar to the post-molding shrinkage. FIG. 14 illustrates an instance of thermal contraction as indicated by arrow B. As the beam members 33, 35 and the reinforcement cap 70 contract, the ends 64, 66 of the reinforcement rods 62 further crush or otherwise deform the ribs 80. FIG. 15 illustrates an instance of thermal expansion as indicated by arrow C. As the beam members 33, 35 and reinforcement caps 70 expand, the free ends 82' of the deformed ribs 80' will move away from the ends 64, 66 of the reinforcement rods 62 leaving a larger hollow annular area 75', however, the ends 64, 66 of the reinforcement rods 62 will still be positioned between the outer and inner cap members 72, 76. The rods 62 remain securely positioned and there is minimal adverse effect between the caps 70 and the beam members 33, 35.

Figure 16:
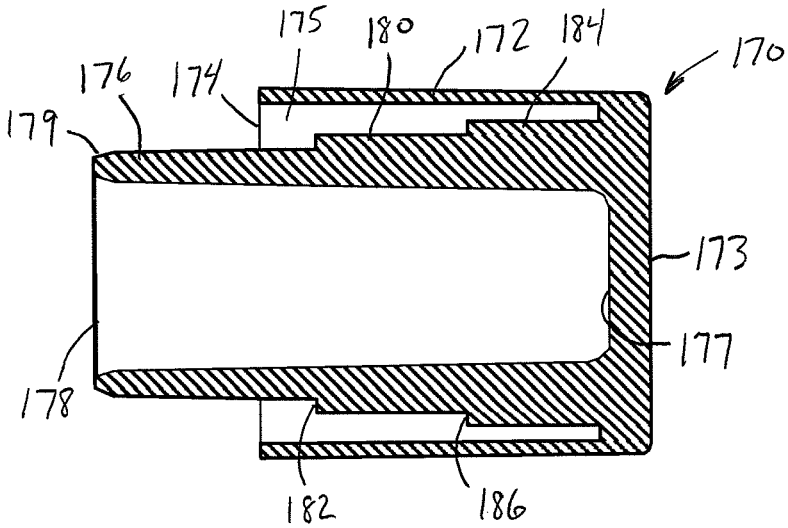
FIG. 16 is a cross-sectional view of an alternative exemplary reinforcement cap.

Referring to FIG. 16, an alternative exemplary reinforcement cap 170 will be described. The exemplary reinforcement cap 170 is similar to the previous embodiment and includes an outer annular cap member 172 having a closed end 173 and an open end 174. An inner cap member 176 is positioned within the outer annular cap member 172, preferably coaxial therewith. The inner cap member 176 extends from a first end 177, formed co-planar with the outer cap member closed end 173, to an opposite end 78 and has a length such that the inner member 176 extends from the open end 174. The extending end 178 of the inner cap member 176 preferably has a tapered edge 179 to facilitate receipt of the inner member 176 into a respective rod end 64, 66. The inner member 176 is illustrated as a hollow structure, but is not limited to such. The outer and inner members 172, 176 of the exemplary embodiment are cylindrical to correspond to the configuration of the rods 62. The cap members 172, 176 may have other configurations which allow attachment to the rod ends 64, 66, however, the cap 170 configuration does not have to be identical to that of the rods 62.

In the present embodiment, the inner compensation structure is defined by a series of steps 180, 184 defined on the outer surface of the inner member 176. Each step 180, 184 defines a respective open end facing stop 182, 186, respectively. The stop 182 is spaced from the open end 174 of the outer cap member 172 such that the initial hollow annular area 175 is defined within the outer cap member 172 between it and the inner cap member 176 from the stop 182 to the open end 174. The hollow annular area 175 is configured to receive the end 64, 66 of a reinforcement rod 62 during assembly as in the previous embodiment. The steps 180 and 184 may be formed as annular members or may be defined by spaced apart ribs. In operation, one or both steps 180, 184 will deform in response to a force from the respective rod end 64, 66 due to contraction of the pallet 10. As such, the reinforcement caps 170 help to accommodate differentials in post mold shrinkage and also thermal expansion and contraction of the pallet beams 33, 35 relative to the reinforcement rods 62.

Figure 17:
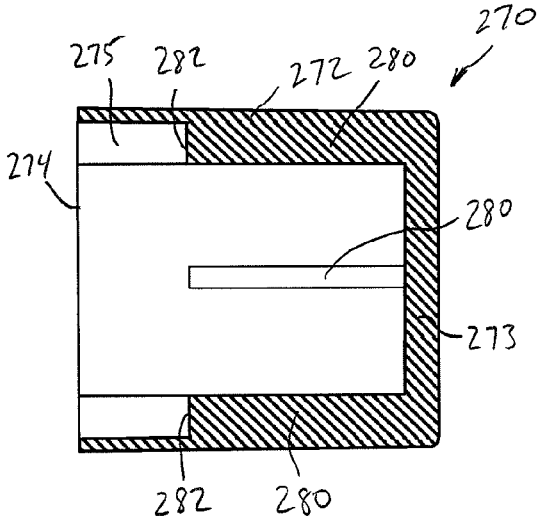
FIG. 17 is a cross-sectional view of another alternative exemplary reinforcement cap.
Figure 18:
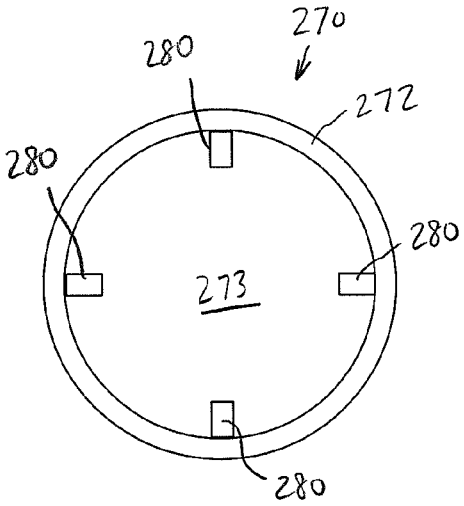
FIG. 18 is an end elevation view of the exemplary reinforcement cap of FIG. 17.

Referring to FIGS. 17 and 18, another alternative exemplary reinforcement cap 270 will be described. The exemplary reinforcement cap 270 is similar to the previous embodiments and includes an outer annular cap member 272 having a closed end 273 and an open end 274, however, the present embodiment does not include an inner cap member. This configuration may be used with a solid or hollow rod 62. The outer member 272 of the exemplary embodiment is cylindrical to correspond to the configuration of the rods 62. The cap member 272 may have other configurations which allow attachment to the rod ends 64, 66, however, the cap 270 configuration does not have to be identical to that of the rods 62.

In the present embodiment, the inner compensation structure is defined by a plurality of ribs 280 extending radially inward from the outer cap member 272 inner surface. Four ribs 80 are shown in the exemplary embodiment, however, more or fewer ribs 280 may be utilized. Similar to the first embodiment, the length of each rib 280 is less than the length of the outer cap member 272 such that a hollow annular area 275 is defined within the outer cap member 272. The free ends 282 of the ribs 280 define a stop which limits initial positioning of the rod end 64, 66 within the outer cap member 272, but the caps 270 do not extend over a substantial length of the rods 62. The hollow annular area 275 may have a larger depth than in the first embodiment to receive more of the rod end 64, 66 since there is no inner member to extend into the rod 62. In the present embodiment, the ribs 280 have a rectangular configuration, but may be formed with a taper similar to the first embodiment. The caps 270 are utilized and operate in substantially the same manner as the caps 70.

Figure 19:
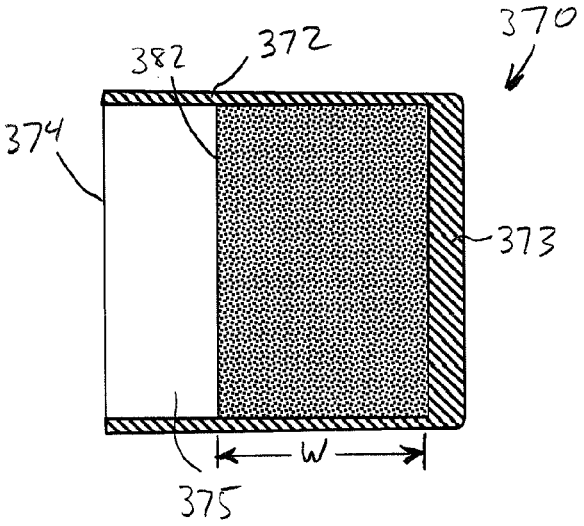
FIG. 19 is a cross-sectional view of yet another alternative exemplary reinforcement cap.

Referring to FIG. 19, another alternative exemplary reinforcement cap 370 will be described. The exemplary reinforcement cap 370 is similar to the previous embodiments and includes an outer annular cap member 272 having a closed end 273 and an open end 274, however, the present embodiment does not include an inner cap member or ribs. This configuration may be used with a solid or hollow rod 62. The outer member 372 of the exemplary embodiment is cylindrical to correspond to the configuration of the rods 62. The cap member 372 may have other configurations which allow attachment to the rod ends 64, 66, however, the cap 370 configuration does not have to be identical to that of the rods 62.

In the present embodiment, the inner compensation structure is defined by an elastomeric insert 380 positioned within the hollow area of the outer member 372. The elastomeric insert 380 has a width W which is less than the length of the outer member 372 such that a hollow annular area 375 is defined within the outer cap member 372 between the open end 374 and an end surface 382 of the elastomeric insert 380. The hollow annular area 375 may have a larger depth than in the first embodiment to receive more of the rod end 64, 66 since there is no inner member to extend into the rod 62. In operation, the elastomeric insert 380 will compress or otherwise deform in response to a force from the respective rod end 64, 66 due to contraction of the pallet 10. As such, the reinforcement caps 370 help to accommodate differentials in post mold shrinkage and also thermal expansion and contraction of the pallet beams 33, 35 relative to the reinforcement rods 62. It is contemplated that the outer member 372 may also be manufactured from an elastomeric material such that the entire reinforcement cap 370 is elastomeric. In such an embodiment, the outer member 372 and the insert 380 may be manufactured as separate components or as a unitary structure.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A pallet comprising:

top and bottom decks supported in spaced apart relationship by a plurality of post assemblies, the top and bottom decks and the post assemblies manufactured from a plastic material; and a reinforcement assembly encapsulated within at least one of the top or bottom deck, the reinforcement assembly including:

at least one reinforcement rod having opposed ends; and a plurality of reinforcement caps, each reinforcement cap having an outer member defining a closed end and an open end; and an inner compensation structure within the outer member and defining a stop surface spaced from the outer member open end such that an initial open area is defined within the outer cap member and a respective rod end is received in the initial open area and wherein the inner compensation structure is configured to deform to accommodate a relative position change between the cap member and the reinforcement rod end.

2. The pallet of claim 1 wherein the top and bottom decks and the post assemblies are formed as a unitarily molded component.

3. The pallet of claim 1 wherein the lower deck includes a plurality of interconnected beams and the reinforcement assembly includes at least one reinforcement rod encapsulated within each beam.

4. The pallet of claim 3 wherein the lower deck includes three lateral beams and three longitudinal beams defining a grid with four equally sized through passages and the reinforcement assembly includes a plurality of reinforcement rods defining a complementary grid.

5. The pallet of claim 1 wherein each reinforcement cap includes an inner cap member coaxial within the outer cap member.

6. The pallet of claim 5 wherein the inner compensation structure is defined by a plurality of ribs extending between the outer and inner cap members.

7. The pallet of claim 6 wherein each rib tapers in a narrowing manner moving from the outer cap closed end to the outer cap open end.

8. The pallet of claim 5 wherein the inner compensation structure is defined by one or more steps extending radially outward from an outer surface of the inner cap member.

9. The pallet of claim 5 wherein the outer cap member has a first length between the closed end and the open end and the inner cap member extends from an inner end at the outer cap member closed end to a free end at a second length, and wherein the reinforcement rod is hollow at each end and the second length is greater than the first length such that the inner cap member extends from the outer cap member and within the respective reinforcement rod.

10. The pallet of claim 9 wherein each rib extends from the outer cap member closed end to a rib free end at a third length which is less than the first length such that the initial open area is defined between the outer cap member and then inner cap member adjacent the outer cap member open end.

11. The pallet of claim 9 wherein each rib has a rectangular non-tapering configuration.

12. The pallet of claim 1 wherein the inner compensation structure is defined by a plurality of ribs extending radially inward from an inner surface of the outer cap member.

13. The pallet of claim 1 wherein the inner compensation structure is defined by an elastomeric insert positioned within the outer cap member.

14. The pallet of claim 13 wherein the outer cap member is manufactured from an elastomeric material.

15. The pallet of claim 14 wherein the outer cap member and the elastomeric insert are formed as a unitary structure.

16. The pallet of claim 1 wherein after molding the pallet is subject to post-molding shrinkage during which the reinforcement rod ends deform the inner compensation structure such that the rod ends extend further within the respective outer cap member.

17. The pallet of claim 1 wherein the at least one reinforcement rod and the corresponding reinforcement caps have complementary configurations.

18. The pallet of claim 17 wherein the at least one reinforcement rod has a circular cross-section and the reinforcement caps have a generally cylindrical configuration.

19. The pallet of claim 1 wherein the top and bottom decks and the post assemblies are manufactured from polypropylene, the at least one reinforcement rod is manufactured from steel and the reinforcement caps are manufactured from nylon 6/6.

20. The pallet of claim 1 wherein the top deck includes a plurality of elastomeric grommets extending therethrough.

21. A method of forming a pallet according to claim 1 comprising:

positioning a reinforcement cap on each end of the at least one reinforcement rod;

positioning the at least one reinforcement rod in a mold in a desired configuration;

molding the top and bottom decks and the post assemblies such that the at least one reinforcement rod and the reinforcement caps thereon are embedded within the top and/or bottom deck.

22. The method of claim 21 wherein a plurality of reinforcement rods are positioned in the mold in a grid configuration.

23. The method of claim 22 wherein the bottom deck is molded as a plurality of beam members defining a grid configuration such that each reinforcement rod and the respective reinforcement caps thereon are embedded within a respective beam member.

24. The method of claim 23 further comprising the step of removing the pallet from the mold and allowing the pallet to cool.

25. The method of claim 24 wherein the pallet experiences post-molding shrinkage and each of the reinforcing rod ends extends further into a respective reinforcement cap without adversely effecting the top and bottom decks and the post assemblies.

26. The method of claim 25 wherein during post-molding shrinkage, the reinforcement rod ends deform the respective inner compensation structure.

* * * * *